United States Patent [19]

Tamaro

[11] Patent Number: 4,771,815

[45] Date of Patent: Sep. 20, 1988

[54] APPARATUS FOR WEFT INSERTION IN A RIBBON GRIPPER LOOM

[75] Inventor: Mario Tamaro, Rüti, Switzerland

[73] Assignee: Sulzer Brothers Limited, Winterthur, Switzerland

[21] Appl. No.: 68,894

[22] Filed: Jun. 30, 1987

[30] Foreign Application Priority Data

Jul. 15, 1986 [CH] Switzerland ..... 2824/86

[51] Int. Cl.[4] ..... D03D 47/12

[52] U.S. Cl. ..... 139/449

[58] Field of Search ..... 139/441, 443, 444, 445, 139/446, 449; 74/89

[56] References Cited

U.S. PATENT DOCUMENTS

| | | | |
|---|---|---|---|
| 3,682,204 | 8/1972 | Dewas | 139/449 |
| 4,274,449 | 6/1981 | Freisler et al. | 139/449 |
| 4,493,347 | 1/1985 | Lutz | 139/449 |

FOREIGN PATENT DOCUMENTS

| | | | |
|---|---|---|---|
| 187645 | 10/1984 | Japan | 139/449 |

*Primary Examiner*—Henry S. Jaudon

*Attorney, Agent, or Firm*—Kenyon & Kenyon

[57] ABSTRACT

The apparatus contains a ribbon wheel driven in alternating direction of rotation with a flexible insertion ribbon being wound and unwound in a first looping region of the ribbon wheel and lappable over more than 360° of the circumference. A ribbon type guide element loops the portion of the insertion ribbon present on the ribbon wheel. The insertion ribbon and the guide element are each fastened at one end in a trough-like depression of the ribbon wheel by a recessed clamp which has a support surface adapted to the adjacent surface portions to be lapped and ascending in a circumferential direction in a continuous arc. The other end of the guide element is fastened by a second clamp disposed in the same or another depression.

20 Claims, 3 Drawing Sheets

APPARATUS FOR WEFT INSERTION IN A RIBBON GRIPPER LOOM

This invention relates to an apparatus for weft insertion in a ribbon gripper loom.

As is known, gripper looms generally have a ribbon wheel which can be driven in an alternating direction of rotation as well as a flexible insertion ribbon mounted on the wheel and carrying an insertion means for a weft thread. In such cases, the ribbon is fastened at one end to the ribbon wheel and is reciprocated cross wise out of and into a shed of warp threads while being wound and unwound in a looping region of the wheel which extends for more than 360° of the circumference of the wheel. In addition, a flexible guide element is usually provided for the ribbon.

For example, U.S. Pat. No. 4,493,347 and Swiss Pat. No. 652,764 describe a guide element in the form of a rope. As described, both ends of the rope are passed through a cutout provided in the peripheral region of the ribbon wheel towards the axle of the ribbon wheel and each is fastened to a tongue arranged inside a body of the ribbon wheel. As further described, one end of the insertion ribbon is fastened by a screw in the peripheral region of the wheel contiguous to the cutout in the unwinding direction of the ribbon. In order to guide the ribbon, a bearing portion is formed at the periphery of the wheel of a constant thickness over about 100° of the circumference of the wheel and a following thickness which continuously increases in the unwinding direction spirally over the remainder of the peripheral portion. This peripheral portion terminates in the region of the cutout with a step or gradation whose height corresponds to the sum of the thicknesses of the rope. Because of this, with a lapping of the ribbon wheel at a looping angle of more than 360°, especially when using a relatively hard insertion ribbon, a gentle kink-free conduction of the insertion ribbon and the guide element takes place. However, when an insertion ribbon consisting of a softer material such as plastic is used, particularly in connection with a ribbon wheel of relatively small diameter, kinks may occur in the portion of the insertion ribbon lapping the clamped end. These kinks may, in turn, lead to a permanent deformation of the insertion ribbon and, thus, may impair the useful life and the conduction of the insertion ribbon. Further, in looms having a small diameter of ribbon wheel, the guide element which is deflected in the region of the cutout, which is of correspondingly small recess is brought under especially heavy stresses.

Accordingly, it is an object of the invention to provide a simplified ribbon wheel for weft insertion in a ribbon gripper loom.

It is another object of the invention to avoid kinks in the insertion ribbon of a ribbon gripper loom where the ribbon wheel is lapped by an angle of more than 360°.

It is another object of the invention to conduct an insertion ribbon in a gentle manner during reciprocation out of and into a shed of warp threads.

It is another object of the invention to provide as relatively compact ribbon wheel construction for a ribbon gripper loom.

Briefly, the invention provides an apparatus for weft insertion in a ribbon gripper loom which includes a ribbon wheel having at least one trough-like periperally disposed depression and at least one clamp disposed in the depression to secure at least one end of a flexible insertion ribbon and/or a flexible quide element therein. In addition, the clamp has an outer support surface which extends in a continuous arc to receive and support a lapped section of at least one of the ribbon and guide element thereon.

The flexible insertion ribbon is looped about the ribbon wheel over an angle greater than 360° and has an end secured to the wheel, for example within the depression, and a weft thread insertion means at a second end.

The flexible guide element has a first section looped over the insertion ribbon with an end secured to the wheel, for example by means of a clamp in a depression of the wheel, as well as a second section which is looped over the wheel in laterally spaced relation to the first section, or the insertion ribbon, with a second end also secured to the wheel, for example by means of a clamp within a depression of the wheel.

The apparatus permits an especially gentle conduction the insertion ribbon in a guide path extending from a clamping point in a depression with a low camber toward the peripheral surface of the wheel. At the same time, a secure conduction of the portion of the insertion ribbon extending over the depression and of the portion of the guide element contiguous thereto is ensured.

For a looping angle of over 360°, during a winding process, a kink-free running up of the respective portion of the ribbon onto the transition between an end section present in the depression and the portion of the guide element looping the ribbon is achievable. Likewise, during the unwinding process, a similar kink-free running off of a respective portion of the ribbon out of the transition region is achievable. These effects are achievable because the arced support surface of the clamp or clamps prevents a "sagging" of the portion of the ribbon and of the guide element contiguous thereto which extend over the depression. Accordingly, additional stress on the material is avoided especially in connection with the great working widths and high weft insertions outputs of modern looms which are already under high stress.

The apparatus is also provided with a guide means for lo guiding the guide element between the two sections thereof on the ribbon wheel. For example, the guide means may include a pair of rollers which are spring biased in a direction away from each other in order to impart tension in the guide element. In one embodiment, the guide element is in the form of a flat ribbon which is cut to length. In this embodiment, each guide roller has a barrel-shaped periphery and the rollers are oriented with a peripheral surface facing a respective section of the guide element on the ribbon wheel while one roller has an axis of rotation oblique to the axis of rotation of the wheel. This embodiment is of particularly compact construction and permits the ribbon wheel to be lapped several times. Although skewed arrangements of guide rollers are known per se in connection with a lateral deflection of a rope type guide element which is cut to length, such skewed arrangements have not been used with flat ribbons.

The arrangement of the flat ribbon guide element with the skewed rollers permits a smooth lateral deflection and, hence, a safe conduction of the guide element in the two looping regions of the ribbon wheel. This leads particularly to a relatively low stress on the insertion ribbon being distributed uniformly over the width of the guide element onto the looped insertion ribbon as well as on the ribbon wheel. This is because high local stresses as may occur, for example, with the use of a rope-like guide element are obviated. As a result, the ribbon wheel which must be stopped and accelerated with every change of direction of rotation, may be made of correspondingly light construction, for example being made of plastic. Likewise, the mass of the ribbon wheel may be correspondingly small. Still further, in contrast to a ropelike guide element, a ribbon guide element cannot "dig" either into the insertion ribbon or through the insertion ribbon into the peripheral surface of the ribbon wheel. Also, the ribbon guide element may have a substantially smaller thickness than a rope-type guide element so that even if the wheel is lapped several times, a relatively small movement mass which is to be accelerated and decelerated alternately results.

The insertion ribbon may also have a zone of lesser stiffness than the remainder of the ribbon at the end which is secured within a depression. Such a zone may also include a first portion which extends within the depression and a second portion which is contiguous to the first portion which extends over and against a transition surface of the ribbon wheel which extends from the depression. Thus, snug application of the insertion ribbon which, as a rule, is relatively stiff (dimensionally stable) can be ensured at the transition surface between the clamping point of the ribbon and the peripheral region of the ribbon wheel.

These and other objects and advantages of the invention will become more apparent from the following detailed description taken in conjunction with the accompanying drawings wherein:

FIG. 1 schematically illustrates an apparatus for weft insertion in a ribbon gripper loom constructed in accordance with the invention;

Figure 1:
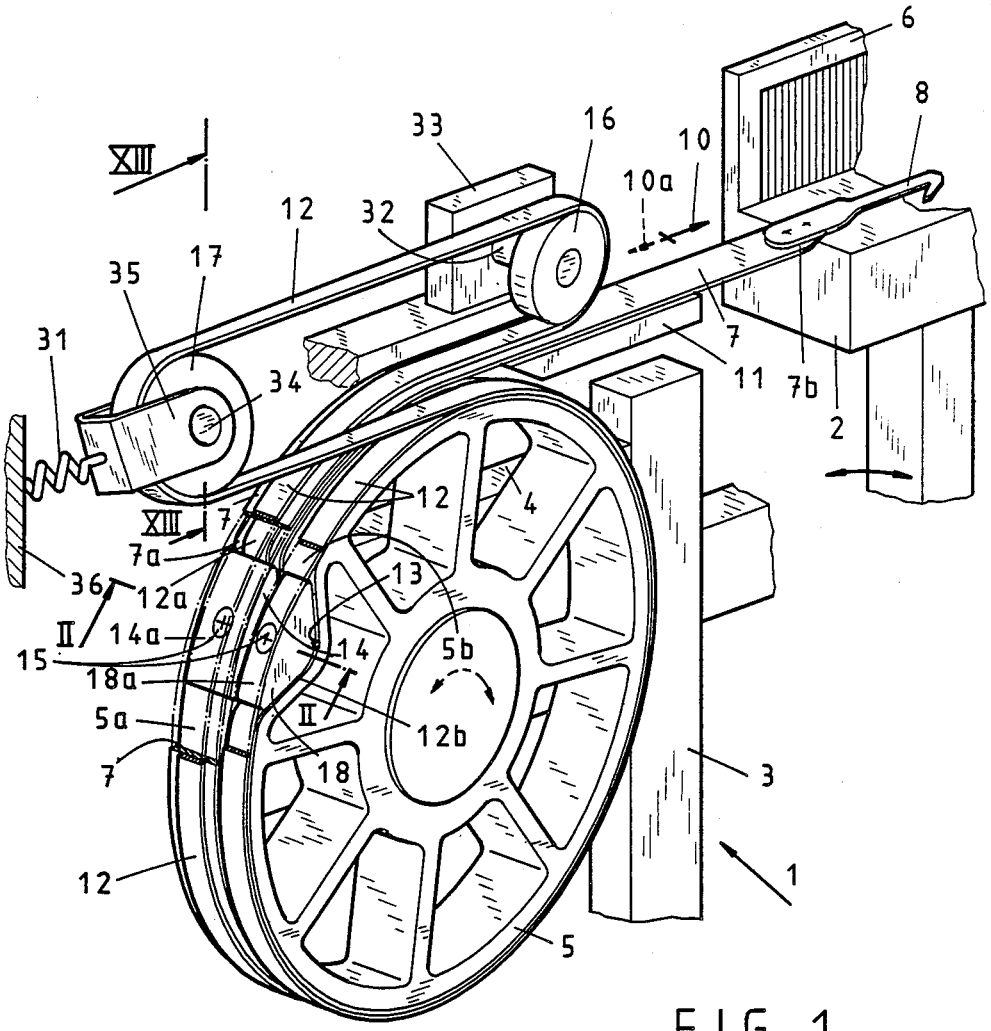

Referring to FIG. 1, the ribbon gripper loom is of generally known construction and includes a machine frame 1 and a batten 2 on which a reed 6 is mounted for guiding warp threads (not shown). The sides of the machine frame 1 are constructed in mirror image symmetry so that only the left side will be further discussed. In this respect, the left side of the machine frame 1 includes a support 3 with a holding plate 4 on which a ribbon wheel 5 is rotatably mounted for oscillation in alternating directions.

As shown, a flexible insertion ribbon 7 is looped about the ribbon wheel 5 with one end *7a* secured to the wheel 5 and a second end *7b* carrying a weft thread insertion means 8 in the form of a gripper head which is intended to seize one end of a weft thread (not shown). A similar insertion ribbon, likewise provided with a gripper head, is fastened on a ribbon wheel on the right-hand side of the machine frame 1. Both ribbon wheels are caused to oscillate and are driven in opposite directions so as to impart an oscillating movement to the insertion ribbons and the gripper heads 8 secured thereon out of and into the shed (not shown) formed by the warp threads as the ribbons are wound and unwound. The gripper heads 8 are continuously moved along the batten 2 up to the center of the shed and are subsequently pulled out of the shed again. From a weft thread reserve arranged outside the shed on the right side (not shown) of the loom, one end of a weft thread is transferred to the gripper head disposed on the right-hand insertion ribbon. From this head, the weft thread is inserted into the first half of the shed and transferred in the center of the shed to the gripper head 8 disposed on the left-hand insertion ribbon 7. Subsequently, the weft thread is inserted by the gripper head 8 into the second half of the shed. After completed weft insertion, the weft thread is beaten up in known manner by the reed 6 in the fell of the shed (not shown).

In the operating position illustrated in FIG. 1, the insertion ribbon 7 is moved in the direction indicated by the arrow 10 on being unwound from the ribbon wheel 5 so that the gripper head 8 is guided toward the center of the thread. In similar fashion, the gripper head 8 is pulled out of the shed after a weft thread transfer by winding up of the ribbon 7 in the direction indicated by the arrow 10*a*. After a change of shed, a new weft insertion can be performed.

The insertion ribbon 7 is looped about the wheel 5 over an angle greater than 360°. For example, approximately 460°, With the gripper head 8 located outside the shed. In addition, a guide rail 11 is provided to guide the ribbon 7 from a run-off point of the wheel 5 toward the guide path provided by the batten 2.

A flexible guide element 12 in the form of a ribbon is provided to prevent a lift-off of the insertion ribbon 7 from the periphery of the wheel 5. As indicated, the guide ribbon 12 is cut to length and is narrower than the insertion ribbon 7.

The guide ribbon 12 has a first section which is looped over the insertion ribbon 7 within a first looping region 5*a* of the wheel 5 as well as a second section which is looped over the wheel 5 in laterally spaced relation to the insertion ribbon 7. In addition, a guide means is provided for guiding the guide ribbon 12 between the two looped sections on the ribbon wheel 5. As illustrated in FIG. 1, this guide means includes a pair of rollers 16, 17 over which the guide ribbon 12 is looped and a spring 31 for biasing the rollers 16, 17 in a direction away from each other to impart tension in the guide ribbon 12. Because of the force provided by the spring 31, the guide ribbon 12 serves to clamp the insertion ribbon 7 against the periphery of the wheel 5.

Figure 4:
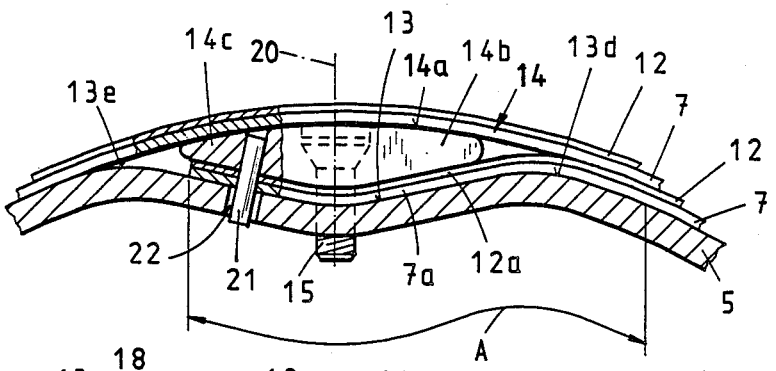
FIG. 4 illustrates a view taken on line IV—IV of FIG. 2.

Referring to FIGS. 1 and 4, the wheel 5 is provided with a trough-like peripherally disposed depression 13 of low camber to receive a first end *7a* of the insertion ribbon 7 and a first end 12*a* of the guide ribbon 12. In addition, a clamp 14 is disposed in the depression 13 in order to secure the two ends of the ribbons 7, 12 therein. As indicated, the clamp 14 is secured by a screw 15 which passes through the clamp 14 and the respective ribbon ends *7a,* 12*a* into the wheel 5.

As shown in FIG. 4, the depression 13 is limited by wall portions 13*d,* 13*e* of a low convex camber which change over to the cylindrical peripheral surface of the wheel 5 thus forming a transition surface.

Figure 5:
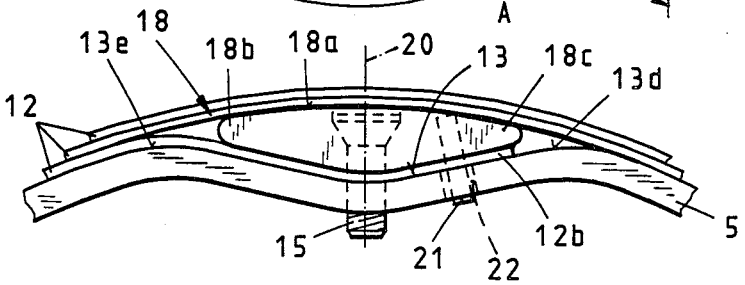
FIG. 5 illustrates a view taken in the direction of arrow V of FIG. 3.

Referring to FIGS. 1 and 5, the ribbon wheel 5 is provided with a second clamp 18 for clamping the second end 12*b* of the guide ribbon 12 in place. As indicated in FIG. 5, the clamp 18 is secured in place by means of a screw 15.

Figure 2:
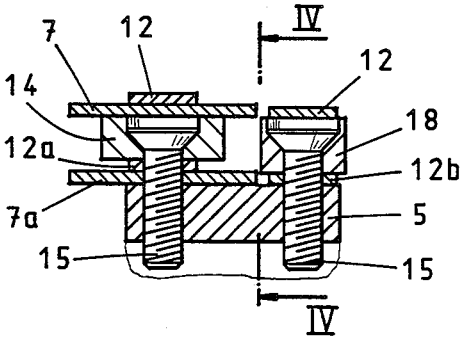
FIG. 2 illustrates a view taken on line II—II of FIG. 1.
Figure 3:
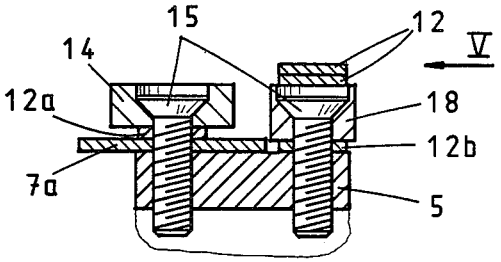
FIG. 3 illustrates a view similar to FIG. 2 in an unwound condition of the ribbon wheel of FIG. 1.

As indicated in FIG. 1, the guide ribbon 12 is looped about the ribbon looping region 5*b* over an angle greater than 360°, for example about 620° when the insertion ribbon 7 has been wound up. During unwinding of the insertion ribbon 7, the portion of the guide ribbon 12 running off from the first looping region 5*a* extends over the roller 16, 17 and is wound up on the second looping region 5*b* of the wheel 5. The condition existing in the region of the claims 14, 18 with the insertion ribbon 7 wound up is shown in FIGS. 1, 2 and 4 whereas the condition with the insertion ribbon unwound is shown in FIGS. 3 and 5.

Figure 12:
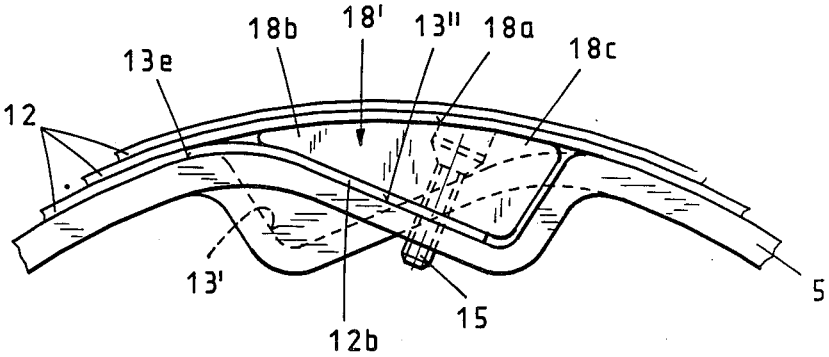
FIG. 12 illustrates a further modified ribbon wheel having a pair of recesses for receiving individual clamps for clamping the insertion ribbon and guide element in accordance with the invention.
Figure 13:
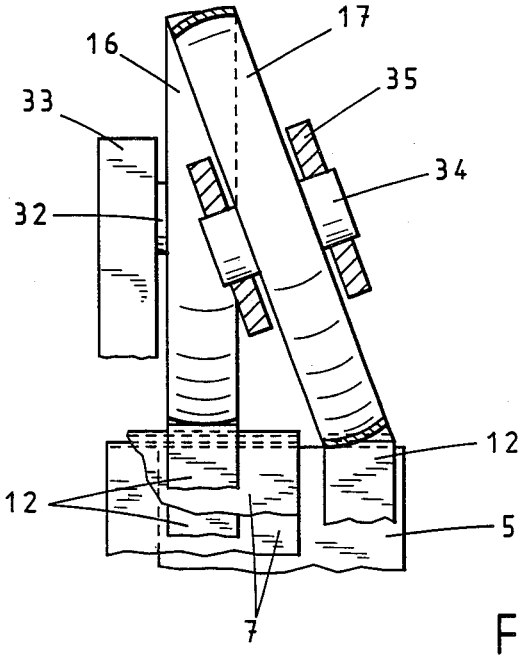
FIG. 13 illustrates a view taken on line XIII—XIII of FIG. 1.
Figure 4:
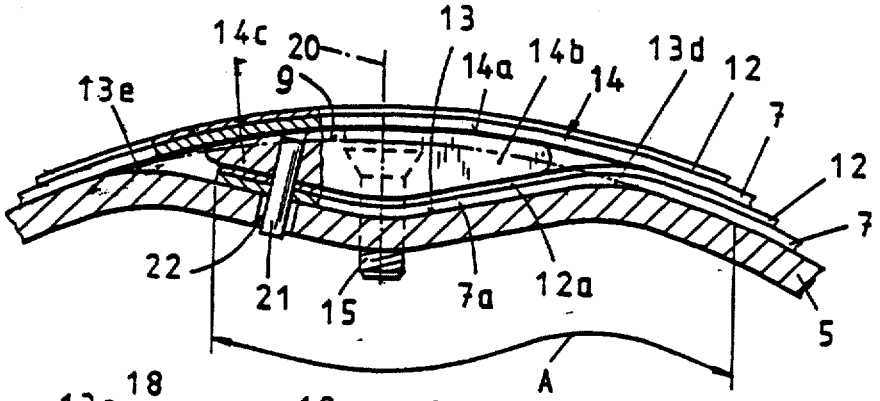
Figure 5:
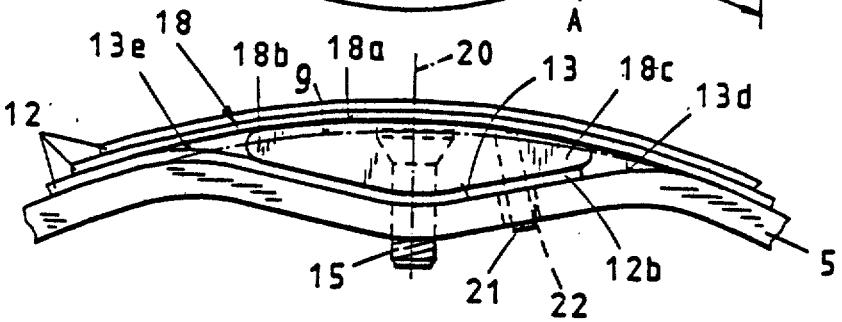
Figure 6:
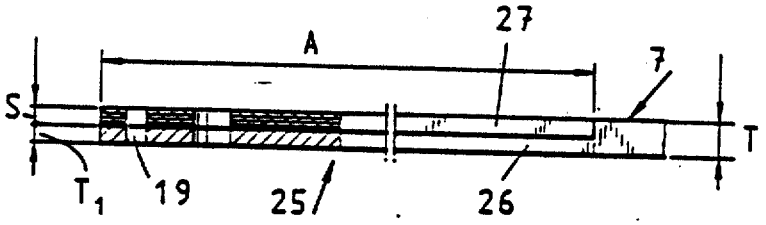
Figure 7:
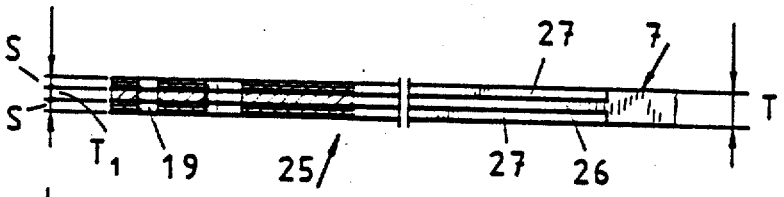
Figure 8:
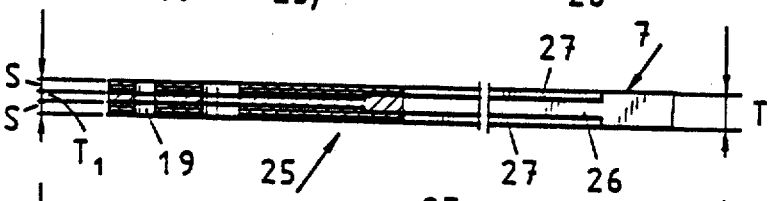
Figure 9:
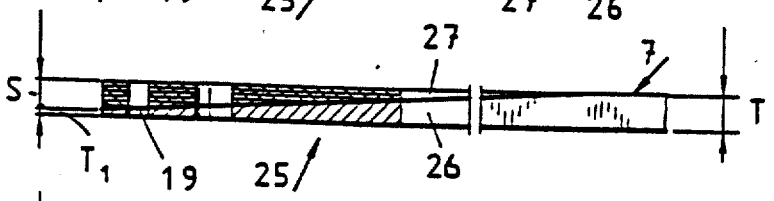
Figure 10:
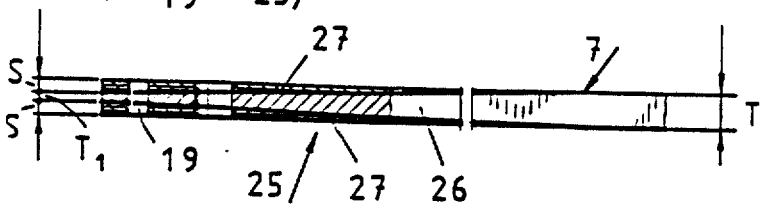
Figure 11:
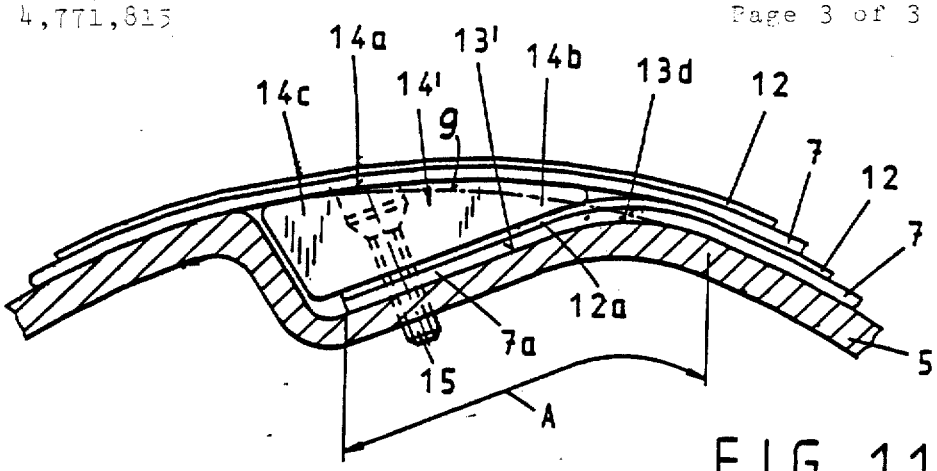
Figure 12:
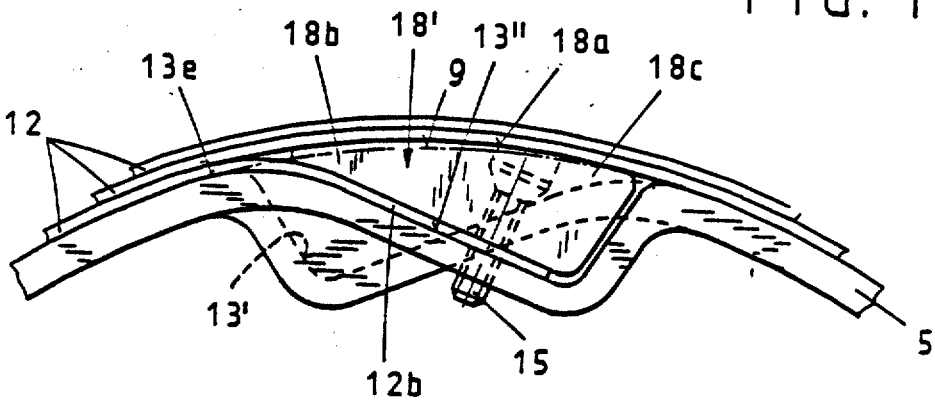
Figure 13:
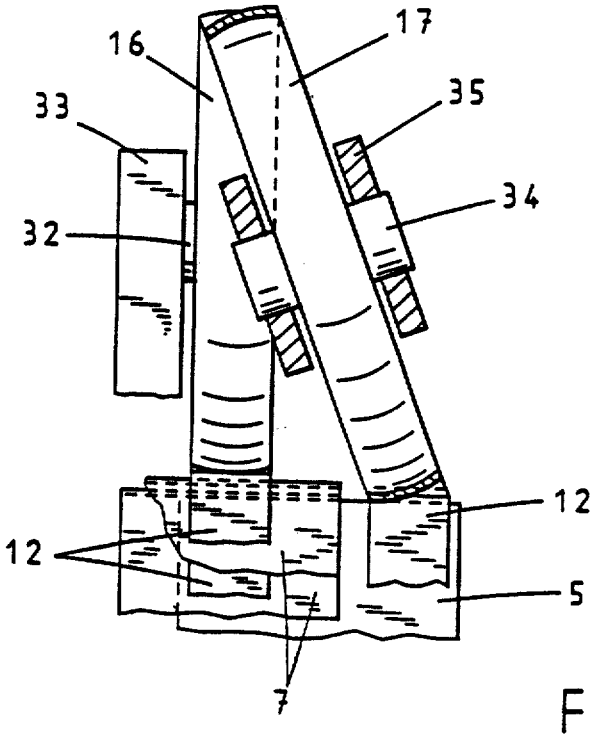

Referring to FIGS. 1 and 12, the guide roller 16 closest to the batten 2 is disposed on an axle 32 which is parallel to the axis of rotation of the wheel 5 and which is mounted on a support 33 connected with the machine frame 1. The other guide roller 17 is rotatably mounted on an axle 34 which is disposed on an axis of rotation oblique to the axis of rotation of the wheel 5. This axle 34 is mounted in a U-shaped bracket 35 which is secured to one end of the spring 31 so as to be mounted on a support part 36 of the machine frame 1. Of note, the spring 31 is shown in simplified form as an extension spring. During weft insertion, spacing differences between the axles 32 and 34 which may result with the winding and unwinding of the ribbons 7, 12 can be compensated. Also, the guide roller 16 may be movable and may cooperate with a similar spring arrangement.

The guide roller 16, 17 have barrel-shaped peripheral surfaces and are skewed relative to each other in such a way that the peripheral regions facing the peripery of the ribbon wheel 5 are offset from each other in the axial direction of the wheel 5 and are oriented toward the respective looping regions 5*a,* 5*b*. In order to fix the angular position of the skewed guide roller 17, suitable guide means may be provided to cooperate with the bracket 35.

Referring to FIGS. 4 and 5, the depression 13 has a cross section which is symmetrical to a radial plane 20 of the wheel 5 while the clamps 14, 18 each have a cross section which is adapted to the shape of the depression 13. Further, each clamp has a support surface 14*a,* 18*a* which is adapted to the course of the portions of the surfaces to be looped contiguous to the depression 13 in both circumferential directions for the respective ribbons 7, 12 lapping the respective clamp 14, 18. That is, each support surface 14*a,* 18*a* extends in a continous arc to receive and support a lapped section of a respective ribbon 7, 12, thereon. As illustrated, each clamp 14, 18 may be non-symmetrical relative to the radial plane 20 such that the respective support surface 14*a,* 18*a* ascends continuously in one or the other circumferential direction of the ribbon wheel with a spiral camber over the "length" of the respective clamp 14,18.

As indicated in FIG. 4, the clamp 14 may be formed so that when placed on the respective ends *7a,* 12*a* of the ribbons 7, 12, one end portion 14*c* is disposed substantially within an imaginary cylindrical reference surface 9 extending over the depression 13 according to a section of the peripheral surface of the wheel 5 while the opposite end portion 14*b* projects radially outwardly of the reference surface 9 or the depression 13 by an amount which at least approximately corresponds to the sum of the thicknesses of the clamped ends *7a,* 12*a*.

Similarly, as indicated in FIG. 5, the clamp 18 when clamping the end of the guide ribbon 12 in place has one end 18*c* disposed substantially within the reference surface 9 of the depression 13 and opposite end portion 18*b* projecting radially outwardly of the reference surface 9 of the depression 13, for instance, by an amount equal to the thickness of the guide ribbon 12.

The support surfaces 14*a,* 18*a* permit a kink-free transition from the cylindrical peripheral surface of the wheel 5 to the winding surface raised by the thickness of the insertion ribbon 7 and of the guide ribbon 12 as indicated in FIG. 4 or by the thickness of the guide ribbon 12 as indicated in FIG. 5 and formed by the surface of the respective portion of the guide ribbon 12. Depending on the material and execution ofthe insertion ribbon 12, a kink-free conduction of the ribbons 7, 12 can be achieved by clamps which are raised on one side by an equal amount, for example, according to the thickness of the insertion ribbon 7, and accordingly have identical cross sections.

Each clamp 14, 18 has means for adjustably mounting the end portion of the clamp 14, 18 in the depression 13. As indicated in FIG. 4, the clamp 14 has a guide means in the form of a pin 21 which is disposed in non-symmetric relation to a surface facing the depression 13 for reception in a recess 22 in the depression 13. As indicated in FIG. 5, the clamp 18 carries a similar guide pin 21 for reception in a second recess 22 of the depression 13. These pins 21 may be inserted into the respective clamps 14, 18 through openings 19 in their respective end portions 14*c,* 18*c* of the clamps 14, 18. By arranging the guide pins 21 in a non-symmetric relation, faulty insertion of the clamps 14, 18 into the depression 13 can be prevented. Further, the recesses 22 may each be in the form of a slot which permits adjustable positioning of the respective clamp 14, 18 in the peripheraly direction of the wheel 5.

As indicated in FIGS. 1 and 2, when in the wound condition, the insertion ribbon 7 laps over the clamp 14 along with the guide ribbon 12 in the region 5*a* of the wheel 5. In this condition, the guide ribbon 12 also laps over the clamp 18 in the region 5*b* of the wheel. When in the unwound condition as indicated in FIG. 3, the insertion ribbon 7 does not lap over the clamp 14. However, the guide ribbon 12 laps twice over the clamp 18.

Of note, a ribbon gripper loom may be constructed so as to utilize only a single ribbon wheel 5 and a single insertion ribbon 7. In this case, the insertion ribbon 7 would be guided from one side of the loom over the full weaving width and back with a gripper head thereon executing one complete weft insertion each time.

Figure 6:
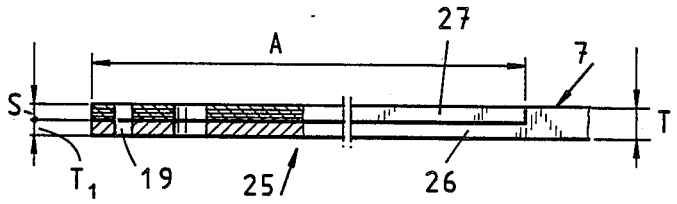
FIG. 6 illustrates a part cross-sectional view of one end of an insertion ribbon constructed in accordance with the invention.

Referring to FIG. 4, the insertion ribbon 7 has a zone 25 of lesser stiffness than the remainder of the ribbon at the secured end. As indicated, this zone 25 extends over a length A which extends from the end of the ribbon 7 through the depression 13 and a transition surface leading to the periphery of the ribbon wheel 5. As indicated in FIG. 6, the zone 25 may be made of two layers 26, 27. In this case, one layer 26 constitutes a continuation of the ribbon 7 and is made of the same relatively stiff base material while the second layer 27 is made of a flexible material which can be secured, for example by bonding to the layer 26. As indicated, the thickness S of the flexible layer 27 may be equal to the thickness T1 of the layer 26 which the total thickness of the layers is equal to the thickness T on the remainder of the ribbon 7.

Figure 7:
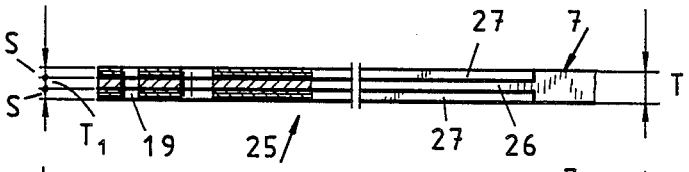
FIG. 7 illustrates a view similar to FIG. 6 of an insertion ribbon having a multi-layered zone of lesser stiffness than the remainder of the ribbon.

Referring to FIG. 7, the flexible zone 25 of the ribbon 7 may be modified so as to have two layers 27 of flexible material sandwiching the layer 26 of the base material of the ribbon. In this case, the thicknesses S of each flexible layer 27 may be equal to the thickness T1 of the base material layer 26 with each corresponding to one third of the thickenss T of the insertion ribbon 7.

Figure 8:
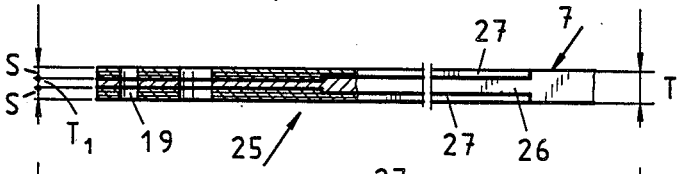
FIG. 8 illustrates a view similar to FIG. 6 of a further modified end zone of an insertion ribbon in accordance with the invention.

Referring to FIG. 8 wherein like reference characters indicate like parts as above, the base material layer 26 may have a stepped thickness which diminishes toward the end of the ribbon 7 while the flexible layers 27 have a thickness which increases in steps.

Figure 9:
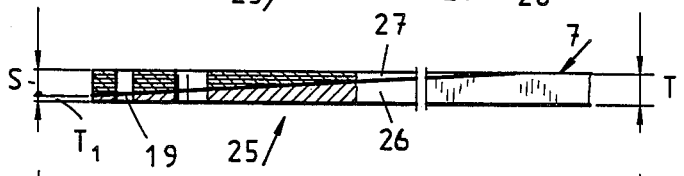
FIG. 9 illustrates a view similar to FIG. 6 of a further modified end zone of an insertion ribbon in accordance with the invention.

Referring to FIG. 9, wherein like reference characters indicate like parts as above, the flexible zone 25 of the ribbon may use a base material layer 26 which decreases in thickness conically toward the end of the ribbon while the flexible material 27 increases conically in thickness toward the end of the ribbon 7.

Figure 10:
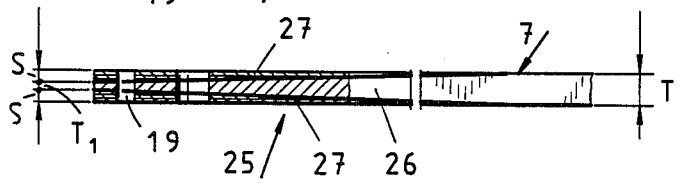
FIG. 10 illustrates a further modified end zone of an insertion ribbon in accordance with the invention.

Referring to FIG. 10, wherein like reference characters indicate like parts as above, the flexible zone 25 may have a base material layer 26 which is sandwiched between two flexible layers 27 while conically decreasing in thickness toward the end of the ribbon 27. In this case, each of the flexible layerse 27 increases conically in thickness toward the end of the ribbon 7.

Figure 11:
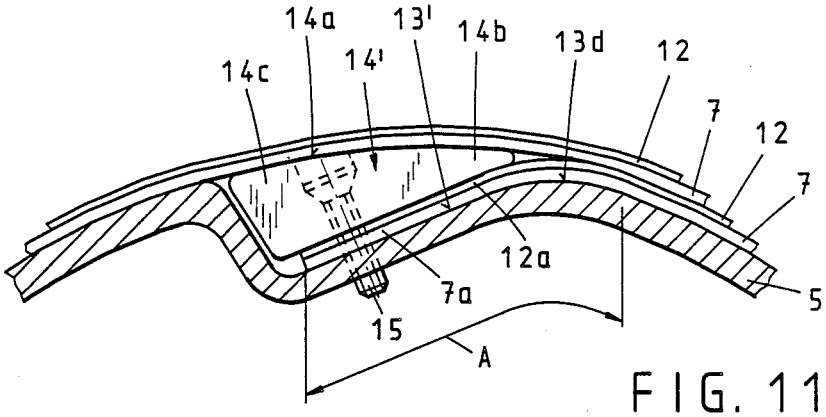
FIG. 11 illustrates a part cross sectional view of a ribbon wheel having a modified depresion and clamp in accordance with the invention.

Referring to FIGS. 11 and 12, the ribbon wheel 5 may alternatively be constructed with two separate depressions 13', 13" which are offset relative to each other in the circumferential direction of the wheel 5 and which are disposed in mirror image symmetry to each other. As viewed in the axial direction of the wheel 5, each depression 13', 13" has an approximately cuneiform cross section which is non-symmetrical with respect to the greatest depth dimension. In corresponding fashion, each clamp 14', 18' is formed with a cuneiform cross section and each has a supporting surface 14*a*, 18*a* which spirally ascends from the region of the peripheral surface of the wheel 5 in the opposite circumferential direction. Each edge portion 14*b*, 18*b* which protrudes beyond the peripheral surface of the wheel 5 is arranged in a converging crosssection region of the clamp 14', 18'. The unmistakable shape of the depressions 13', 13" prevents a wrong insertion of the clamps 14', 18' so as to elminate the need for a special guide means in this respect.

Of note, other embodiments of the structure are possible. For example the support surfaces for the insertion ribbon 7 and for the portion of the guide ribbon 12 to be wound and unwound next to the insertion ribbon 7 may be formed by a common clamp which extends over both looping regions 5*a*, 5*b*. Further, the respective ends 7*a*, 12*a* of the ribbons 7, 12 in the same looping region 5*a* may be fastened by separate clamps in separate depressions of the wheel 5 with the depressions being offset from each other in the circumferential direction of the looping region 5*a*.

Further, instead of using a flat guide ribbon 12, a rope type guide element may be provided.

Further, the use of a clamp recessed in a trough-like depression of a ribbon wheel may also be used in connection with a guide element which is in the form of an endless belt or band which loops only the outermost winding layer of the portion of the insertion ribbon which is present on a ribbon wheel.

The invention thus provides an apparatus which permits a kink-free conduction of an insertion ribbon for a lapping of a ribbon wheel over an angle of more than 360°.

Further, the invention provides an apparatus which is able to gently conduct the guide element for an insertion ribbon of a ribbon gripper loom while providing a compact construction.

Further, the invention permits the use of relatively soft insertion ribbon as well as relatively small diameter ribbon wheels in a ribbon gripper loom.

What is claimed is:

1. Apparatus for weft insertion in a ribbon gripper loom, said apparatus comprising a ribbon wheel mounted for oscillation in alternating directions and having at least one trough-like peripherally disposed depression therein;

a flexible insertion ribbon looped about said wheel over an angle greater than 360° and having a first end secured to said wheel and a weft thread insertion means at a second end;

a flexible guide element having a first section looped over said insertion ribbon with a first end secured to said wheel and a second section looped over said wheel in laterally spaced relation to said insertion ribbon with a second end secured to said wheel; and at least one clamp disposed in said depression to secure at least one of said three ends therein, said clamp having an outer support surface extending in a continuous arc to receive and support a lapped section of at least one of said ribbon and said guide element thereon.

2. An apparatus as set forth in claim 1 which further comprises guide means for guiding said guide element between said sections thereof on said wheels.

3. An appparatus as set forth in claim 2 wherein said guide means includes a pair of rollers having said guide element looped thereover and a spring biasing said rollers in a direction away from each other to impart tension on said guide element.

4. An apparatus as set forth in claim 3 wherein said guide element is a ribbon and each roller has a barrel-shaped periphery.

5. An apparatus as set forth in claim 4 wherein at least one roller has an axis of rotation oblique to an axis of rotation of said wheel and each respective roller being oriented with a peripheral surface facing a respective section of said guide element on said wheel.

6. An apparatus as set forth in claim 1 wherein said clamp has a first end portion disposed substantially within an imaginary cylindrical reference surface extending over said depression according to a section of the peripheral surface of the ribbon wheel and a second end portion projecting radially outwardly of said reference surface extending over said depression.

7. An apparatus as set forth in claim 6 which further comprises means for adjustably mounting said first end portion of said clamp in said depression.

8. An apparatus as set forth in claim 6 wherein said depression has a cross-section symmetrical to a radial plane of said wheel and said clamp includes a guide means disposed on a surface facing said depression in non-symmetric relation to said surface for reception in a recess of said depression.

9. An apparatus as set forth in claim 1 wherein said first end of said ribbon is secured in said depression, and said ribbon has a zone of lesser stiffness than the remainder of said ribbon at said first end, said zone including a first portion extending within said depression and a second portion contiguous to said first portion extending over and against a transition surface of said wheel extending from said depression.

10. An appartus as set forth in claim 9 wherein said zone is formed of at least two layers, at least one layer being made of flexible material.

11. An apparatus as set forth in claim 10 wherein said one layer of flexible material has a constant thickness.

12. An apparatus for weft insertion in a ribbon gripper loom, said apparatus comprising a ribbon wheel having a peripherally disposed depression;

a flexible insertion ribbon looped about said wheel over an angle greater than 360° and having an end disposed in said depression;

a flexible guide element having a first section looped over said insertion ribbon with a first end disposed in said depression and a second section looped over said wheel in laterally spaced relation to said first section with a second end secured to said wheel; and a clamp disposed in said depression to secure said end of said ribbon and said first end of said guide element therein, said clamp having an outer support surface extending in a continuous arc to receive and support a lapped section of said ribbon and said guide element thereon.

13. An apparatus as set forth in claim 12 which further comprises guide means for guiding said guide element between said sections thereof on said wheels.

14. An apparatus as set forth in claim 12 wherein said clamp has a first end portion disposed substantially within an imaginary cylindrical reference surface extending over said depression according to a section of the peripheral surface of the ribbon wheel and a second end portion projecting radially outwardly of said reference surface extending over said depression.

15. An apparatus as set forth in claim 12 wherein said depression has a cross-section symmetrical to a radial plane of said wheel and said clamp includes a guide means disposed on a surface facing said depression in non-symmetric relation to said surface for reception in a recess of said depression.

16. An apparatus as set forth in claim 12 wherein said ribbon has a zone of lesser stiffness than the remainder of said ribbon at said first end, said zone including a first portion extending within said depression and a second portion contiguous to said first portion extending over and against a transition surface of said wheel extending from said depression.

17. An apparatus as set forth in claim 12 which further comprises a second clamp in said depression securing said second end of said guide element therein.

18. An apparatus as set forth in claim 12 which further comprises a second depression in said wheel receiving said second end of said guide element and a second clamp in said second depression securing said second end of said guide element therein.

19. An apparatus as set forth in claim 18 wherein each clamp has a first end portion disposed substantially within an imaginary cylindrical reference surface extending over said depression according to a section of the peripherial surface of the ribbon wheel and a second end portion projecting radially outwardly of said reference surface extending over said depressions by an amount corresponding to the thickness of a lapped section of said ribbon and said guide element thereat.

20. An apparatus as set forth in claim 18 wherein said depressions are circumferentially offset and are in mirror-image symmetry to each other.

* * * * *

UNITED STATES PATENT AND TRADEMARK OFFICE

CERTIFICATE OF CORRECTION

PATENT NO. : 4,771,815

DATED : September 20, 1988

INVENTOR(S) : MARIO TAMARO

It is certified that error appears in the above-identified patent and that said Letters Patent is hereby corrected as shown below:

Column 1, line 61 "as" should be -a-
Column 2, line 20 "tion the" should be -tion of the -
Column 2, line 40 "tions" should be -tion-
Column 2, line 43 cancel "lo"
Column 3, line 59 "depresion" should be -depression-
Column 4, line 48 "With" should be -with-
Column 5, line 27 "roller" should be -rollers-
Column 5, line 29 "claims" should be -clamps-
Column 5, line 49 "roller" should be -rollers-
Column 5, line 51 "peripery" should be -periphery-
Column 6, line 14 "or" should be -of-
Column 6, line 53 "peripheraly" should be -peripheral-
Column 7, line 22 "thickenss" should be -thickness-
Column 7, line 39 "layerse" should be -layers-
Column 7, line 56 "crossection" should be -cross-section-
Column 9, line 19 "appartus" should be -apparatus- The sheets of drawings consisting of figures 4-13 should be deleted to be replaced with figures 4-13 as shown on the attached sheets.

Signed and Sealed this

Twenty-eighth Day of February, 1989

*Attest:*

DONALD J. QUIGG

*Attesting Officer*

*Commissioner of Patents and Trademarks*